US012345493B1

(12) United States Patent
Withey

(10) Patent No.: US 12,345,493 B1
(45) Date of Patent: Jul. 1, 2025

(54) TOOL-LESS TAKEDOWN BUSHING/COMPENSATOR DEVICE FOR PISTOL

(71) Applicant: Kimber IP, LLC, Troy, AL (US)

(72) Inventor: Michael Withey, Brundidge, AL (US)

(73) Assignee: Kimber IP, LLC, Troy, AL (US)

( * ) Notice: Subject to any disclaimer, the term of this patent is extended or adjusted under 35 U.S.C. 154(b) by 0 days.

(21) Appl. No.: 18/776,024

(22) Filed: Jul. 17, 2024

(51) Int. Cl.
*F41A 21/36* (2006.01)
*F41A 21/32* (2006.01)

(52) U.S. Cl.
CPC ..... *F41A 21/36* (2013.01); *F41A 21/325* (2013.01)

(58) Field of Classification Search
CPC ..... F41A 21/36; F41A 21/325
USPC ..... 89/14.3
See application file for complete search history.

(56) References Cited

U.S. PATENT DOCUMENTS 984,519 A 2/1911 Browning
2,935,000 A 5/1960 Mowrey
4,715,140 A * 12/1987 Rosenwald ..... F41A 3/86 89/14.3
2010/0095576 A1 4/2010 Johns
2012/0291330 A1 11/2012 Johnson
2016/0282072 A1 9/2016 Adamietz
2023/0175797 A1 6/2023 Dawson, Jr.

* cited by examiner

*Primary Examiner* — Samir Abdosh
(74) *Attorney, Agent, or Firm* — Kaplan Breyer Schwarz, LLP

(57) ABSTRACT

A bushing/compensator device for a firearm is provided that includes a compensator member having a first aperture having an axis that is coaxial with the axis of the barrel. A second aperture has an axis that is coaxial with the axis of the guide rod when the device is mounted on the slide. A quarter turn bayonet mount is disposed at a rear end of the first aperture that mates with a bayonet mount aperture in the slide. When the bayonet mount is locked, the axis of the second aperture is aligned with the axis of the guide rod of the pistol, and when the bayonet mount is unlocked, the device is removable from the slide. A button assembly is retained in the second aperture and includes a head at one end and a fastener at the other. The rod is slidable from a first position wherein the head is adjacent to the front end of the second aperture, to a second position wherein the second end of the rod depresses the recoil spring plug. A spring biases the rod to the first position.

5 Claims, 13 Drawing Sheets

TOOL-LESS TAKEDOWN BUSHING/COMPENSATOR DEVICE FOR PISTOL

BACKGROUND OF THE INVENTION

The present invention relates to handgun compensators. More particularly, the present invention relates to handgun compensators that provide for ease of disassembly of the handgun to which it is attached.

The M1911-style handgun was initially developed and commercialized by John Browning more than 100 years ago in 1911, and patented as U.S. Pat. No. 984,519 (Browning). This handgun employed a then-novel mechanism for firing in a semiautomatic fashion substantially large cartridges of .45 caliber, for example .45 ACP (Automatic Colt Pistol) cartridges. This handgun is sometimes referenced as the Government Model 1911 and was for many years favored for use in the U.S. military and served as a hand weapon for U.S. soldiers in the World Wars. This weapon is still favored for personal defense, because it is capable of shooting a relatively large caliber bullet which has substantial "stopping power" when used against animals or humans.

Routine maintenance of the handgun is a considerable factor in contributing to ease of ownership and handgun safety. Accordingly, the periodic cleaning of the handgun is an absolute necessity. To accomplish this, the handgun must be disassembled from time to time. One must have the proper tools to disassemble the handgun. Over the years since the introduction of the 1911 pistol, many developments and improvements have been made. Generally, 1911-style pistols come in two basic barrel styles, bushing and non-bushing (sometimes referred to as a "bull barrel"). Disassembly of a 1911 pistol requires recoil spring compression to enable removal of the recoil spring guide assembly from the slide and subsequent removal of the barrel for cleaning, repair, replacement, and the like.

To disassemble the 1911 pistol for cleaning and repair, the procedure for disassembly of a bushing-style pistol is essentially the same for pistols manufactured by most manufacturers. The procedure involves rotation and removal of a barrel bushing, recoil spring, recoil spring plug and guide rod. The barrel busing is typically pressed in by hand and rotated to accomplish removal of the barrel bushing, recoil spring, recoil spring plug and guide rod. While removal can be done by hand, it is often difficult since the user must press against the force of the recoil spring, while rotating the barrel bushing. Control of the various elements is important to avoid inadvertent and unintended ejection of the recoil spring and recoil spring plug that can cause injury. Often, a barrel bushing tool is used to assist with the process. The barrel bushing wrench is a wrench having the general shape of the barrel bushing. The wrench is fitted onto the barrel bushing and turned ninety degrees.

Compensators for pistols provide numerous advantages, for example, a compensator may help reduce recoil created when firing the pistol, thereby reducing muzzle flip. Typically, a compensator is deployed with one or more chambers arrayed along the trajectory that a bullet follows when leaving the cartridge casing. Such chambers may be configured with a generally vertical exit wall. The chamber typically is open at the top if it is deployed to reduce muzzle flip. A portion of the gases propelling the bullet through the chamber and barrel and strikes the vertical exit wall and creates a force generally parallel to the barrel away from the hand holding the pistol. A portion of those gases exits the vertical opening, thereby imparting a downward force on the muzzle to assist in reducing muzzle flip.

A pistol compensator is often attached to the barrel by the use of threads on the compensator that mate with treads on the compensator. In 1911 pistols that have bushing-style barrels, the compensator may also include elements of the bushing such that a combined bushing/compensator may be implemented as a single device. The traditional method for removal of the compensator is to cut the bottom of the compensator short (at the location of the recoil spring plug such that the barrel bushing and recoil spring plug are accessible. Another design uses a full-length compensator, where the compensator has an aperture to enable access to the recoil spring plug, where a separate rod or other tool may be inserted to depress the plug to enable rotation of the compensator to disassemble the pistol.

It would be beneficial to have an improved compensator allowing for removal of the compensator and for disassembly of the pistol that allows for a full-length compensator, but allows for disassembly of the pistol without a separate tool.

SUMMARY OF THE INVENTION

In a first exemplary embodiment of the present invention, a semiautomatic pistol having a frame, a barrel having a longitudinal axis, a slide having a front end surrounding the barrel, a recoil spring disposed in the slide, a recoil spring plug and a guide rod having a longitudinal axis is provided. A bushing/compensator device for the semiautomatic pistol provides for tool-less disassembly of the slide from the frame of the pistol. The bushing/compensator device includes a compensator member having a front end and a rear end. The compensator member includes a first aperture extending between the front end and the rear end of the compensator member. The first aperture has a front end, a rear end, and a longitudinal axis that is coaxial with the longitudinal axis of the barrel. The compensator member includes a second aperture extending between the front end and the rear end of the compensator member, and has a front end, a rear end, and a longitudinal axis that is coaxial with the longitudinal axis of the guide rod of the pistol when the bushing/compensator device is mounted on the slide. A quarter turn bayonet mount is disposed at a rear end of the first aperture that mates with a bayonet mount aperture in the front end of the slide, wherein when the bayonet mount is in a locked position, the longitudinal axis of the second aperture is aligned with the longitudinal axis of the guide rod of the pistol, and when the bayonet mount is rotated to an unlocked position, the bushing/compensator device is removable from the slide. A button assembly is slidingly retained in the second aperture, and includes a rod having a first end and a second end. The first end has a head, and the second end is for receipt of a fastener. The rod is slidable from a first longitudinal position wherein the head is adjacent to the front end of the second aperture, to a second longitudinal position wherein the second end of the rod depresses the recoil spring plug. Finally, the button assembly includes a spring to bias the rod to the first longitudinal position. When a user depresses the first end of the rod, the second end of the rod depresses the recoil spring plug providing clearance to provide for the bushing/compensator device to be rotated from the locked position to the unlocked position.

The second aperture may include a first annular ledge to engage the head of the rod to provide for a stop when the rod reaches the second position. The second aperture may also include a second annular ledge to engage the fastener to provide for a stop when the rod reaches the first position. Finally, the second aperture may include a third annular ledge such that the spring is captured between the third annular ledge and the head of the rod.

DETAILED DESCRIPTION

The present invention is directed to a semiautomatic pistol. Specifically, the invention is directed to a 1911-style semiautomatic pistol that utilizes a bushing disposed on the slide that is adjacent to the barrel of the pistol, as is well known. More specifically, the present invention is primarily directed 1911-style semiautomatic pistols having short, G.I. style guide rods (as compared with full length guide rods). However, the present invention would be appropriate for any firearm that utilizes a similar bushing style mechanism for assembly/disassembly purposes.

Figure 1:
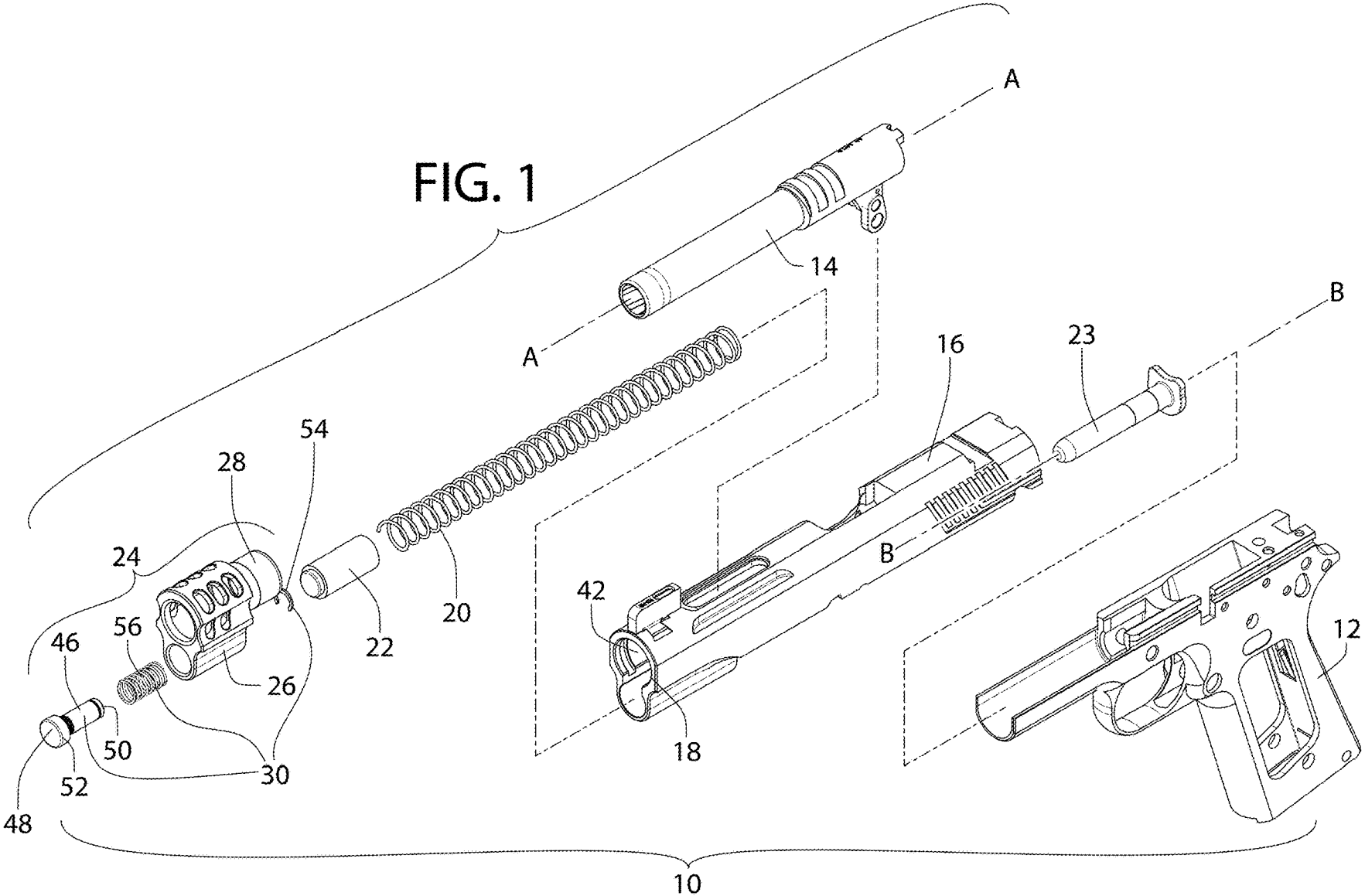
FIG. 1 is an exploded, isometric view of pistol having a tool-less takedown bushing compensator device in accordance with an exemplary embodiment of the present invention.
Figure 2:
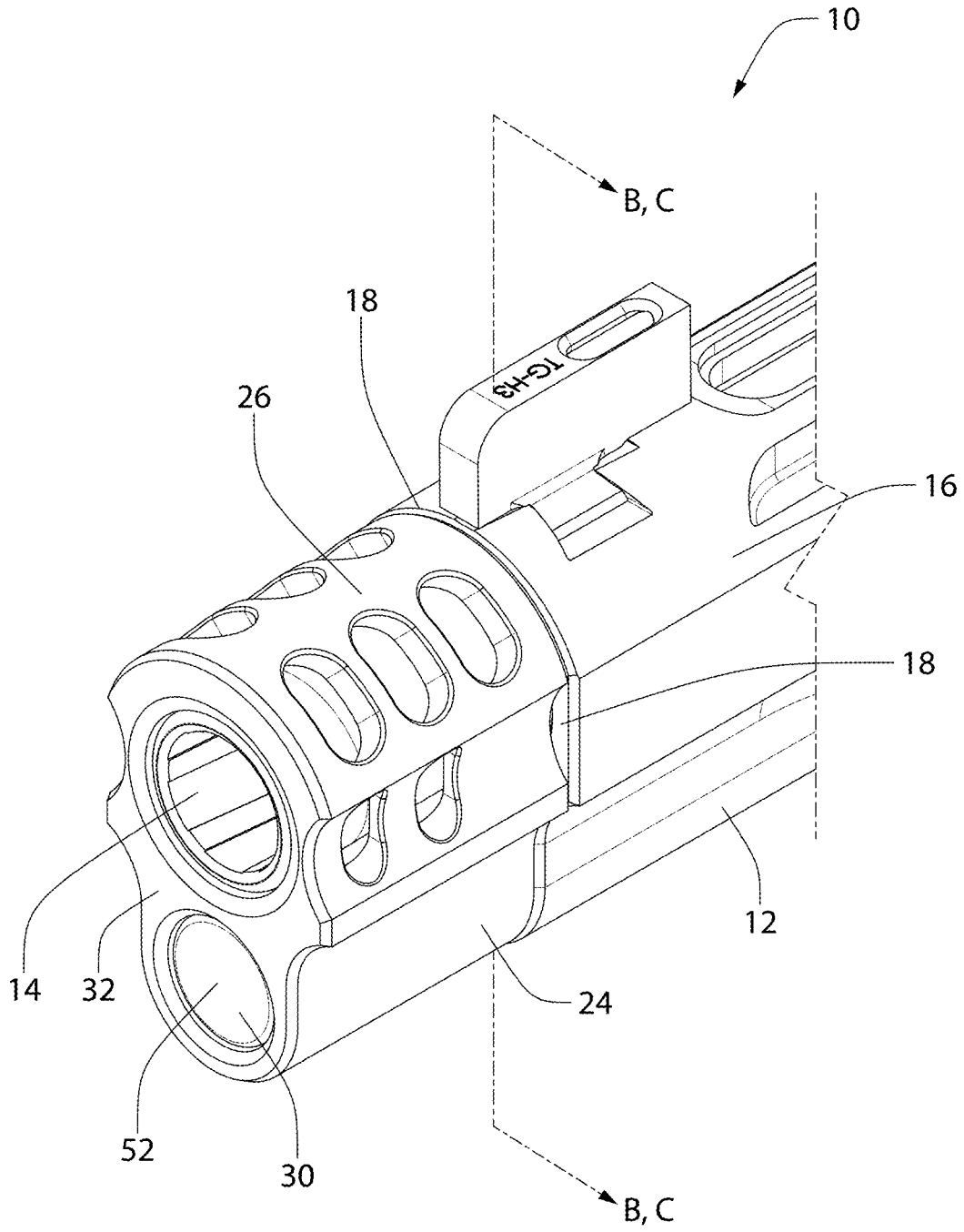
FIG. 2 is an enlarged, isometric view of the front end of a pistol having the bushing/compensator device of FIG. 1.
Figure 3:
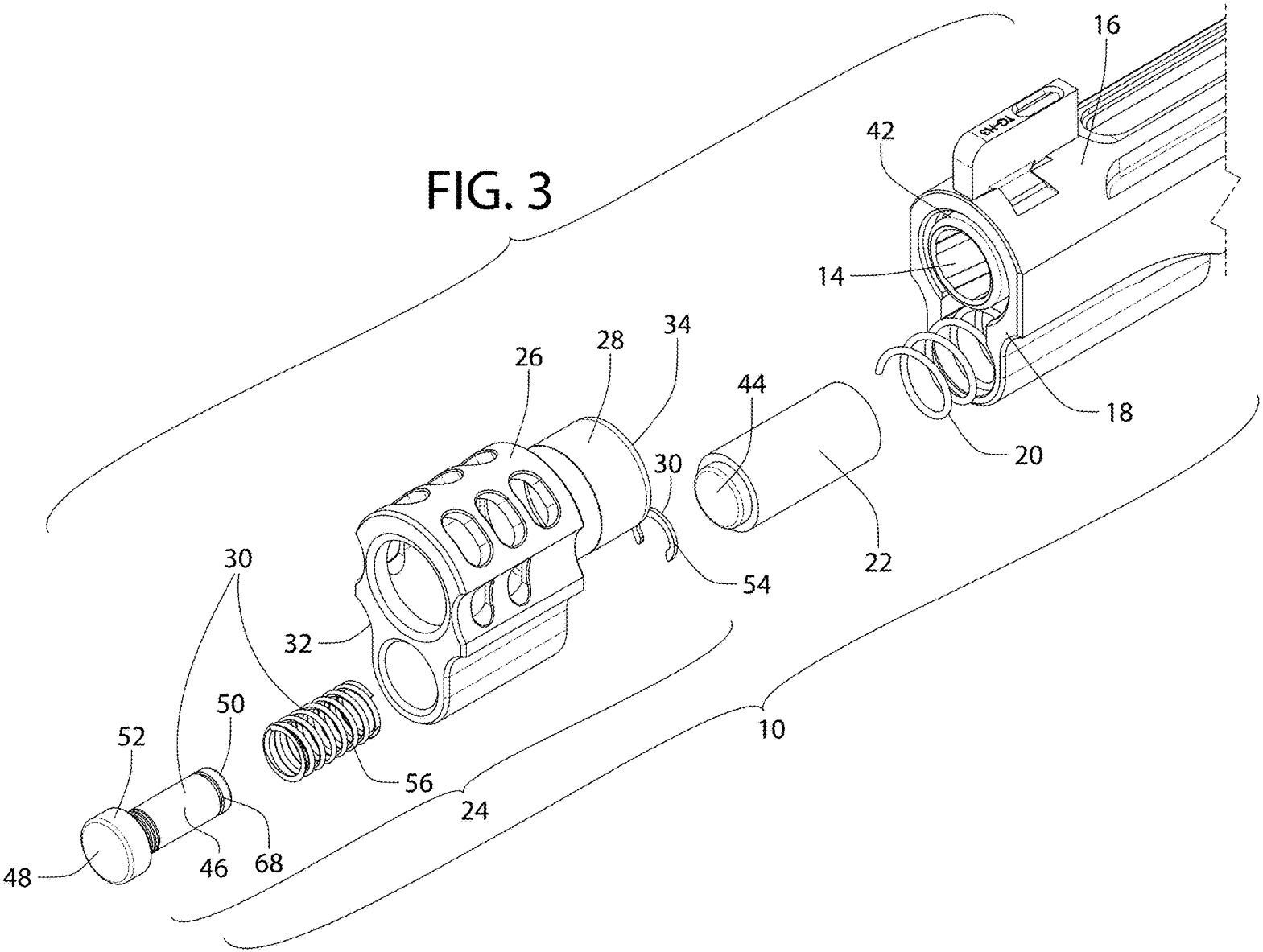
FIG. 3 an exploded, isometric view of the pistol of FIGS. 1 and 2.
Figure 4:
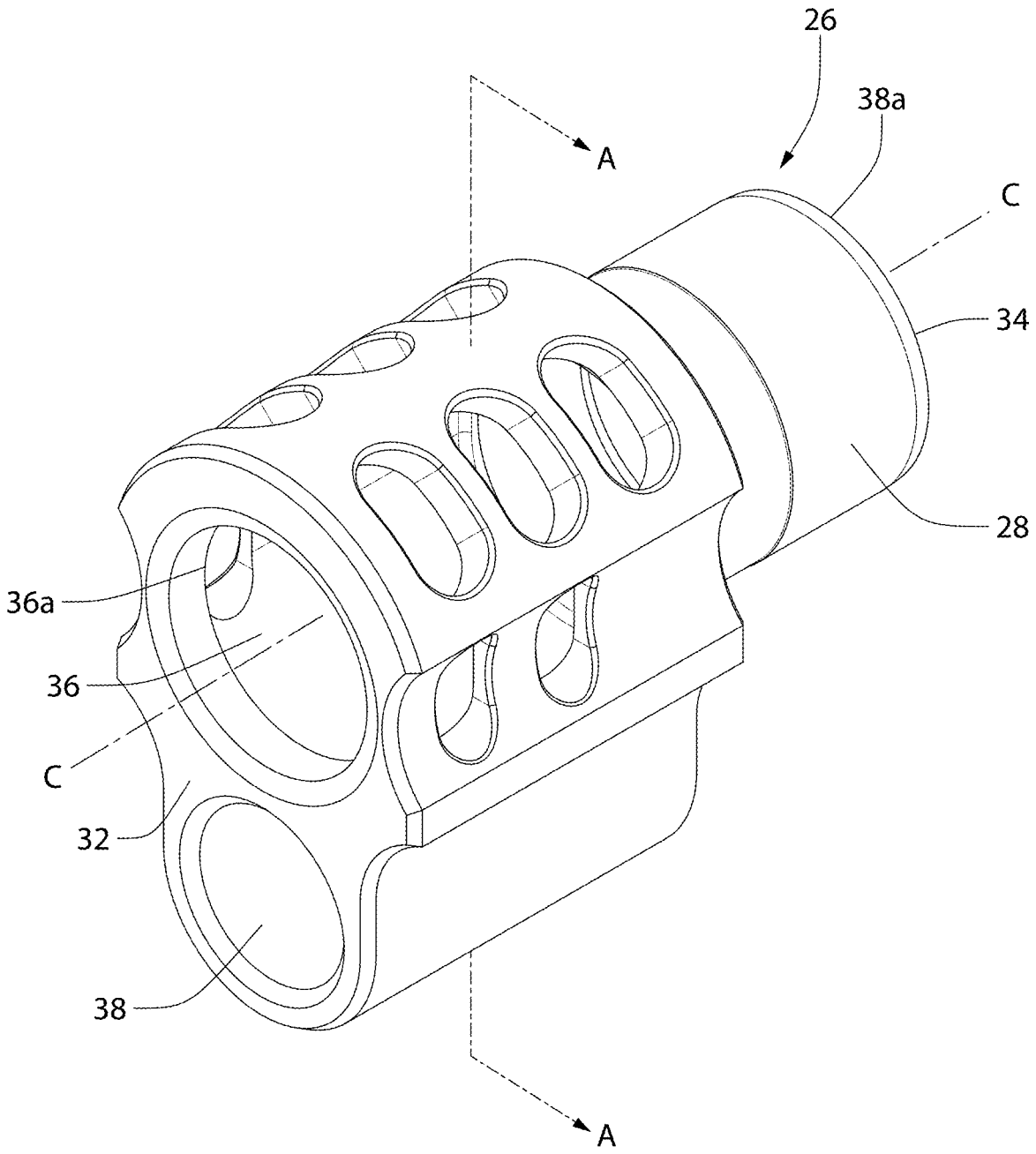
FIG. 4 is a top, front isometric view of a compensator member of the bushing/compensator device of FIG. 1.
Figure 5:
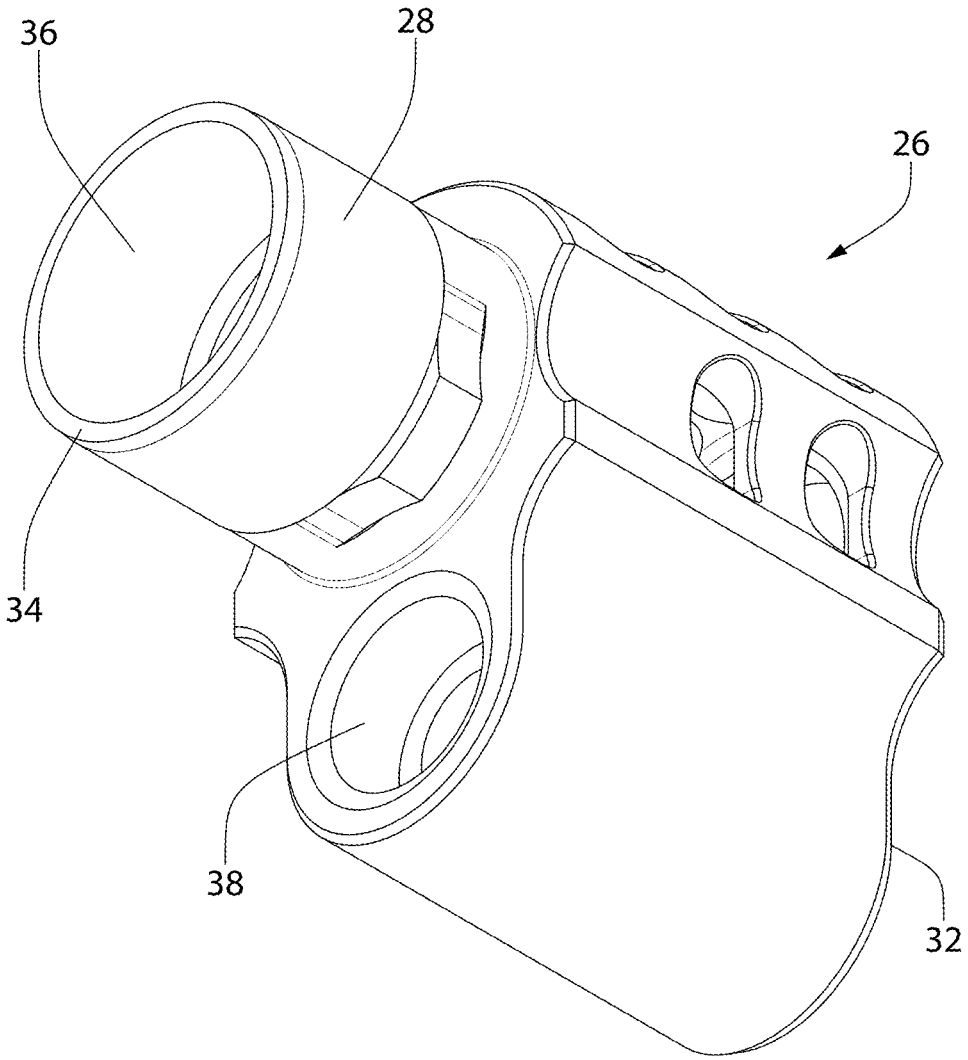
FIG. 5 rear, bottom isometric view of the compensator member of FIG. 4.

Referring now to the drawing figures, wherein like reference numbers refer to like elements throughout the several views, there is shown in FIGS. 1-3, a semiautomatic pistol 10 having a frame 12, a barrel 14 having a longitudinal axis A, a slide 16 having a front end 18 surrounding the barrel 14, a recoil spring 20 disposed in the slide 16, a recoil spring plug 22, and a guide rod 23 having a longitudinal axis B. The present invention is directed to a bushing/compensator device 24 for the semiautomatic pistol 10 that provides for tool-less disassembly of the slide 16 from the frame 12 of the pistol 10.

Figure 6:
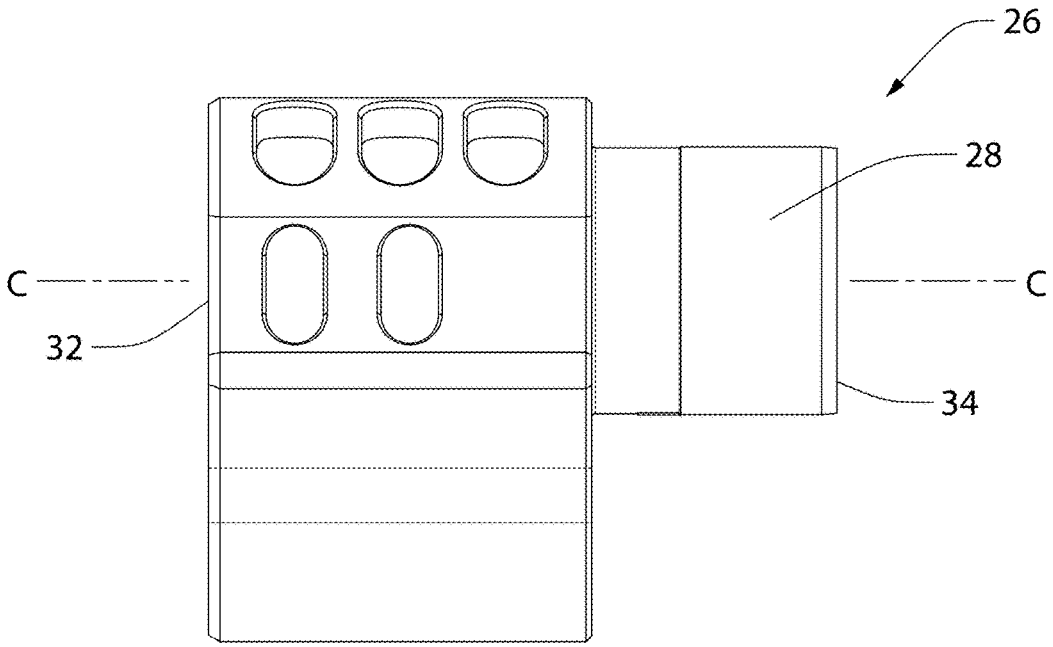
FIG. 6 is a side elevation view of the compensator member of FIG. 4.
Figure 10B:
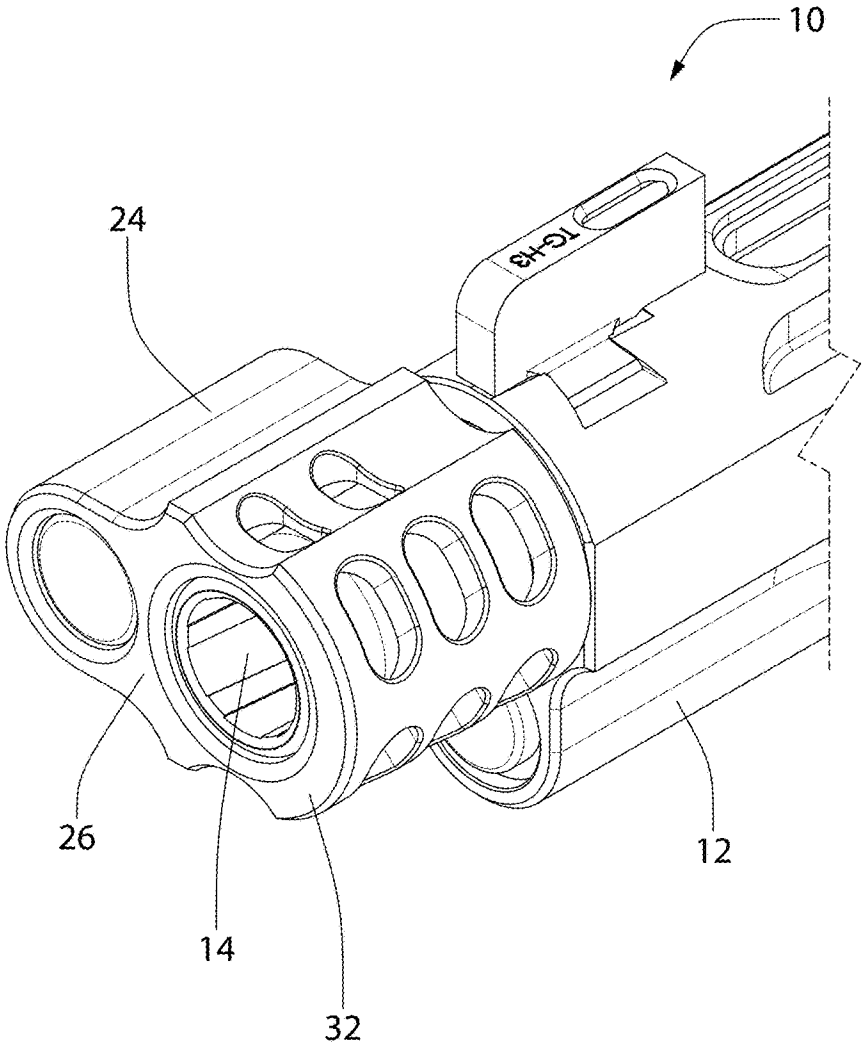
FIG. 10B is an isometric view of the bushing/compensator device as attached to a pistol of FIG. 1, shown with the bushing/compensator installed on a slide of the pistol in an unlocked position wherein disassembly of the pistol is possible by initially removing the bushing/compensator device from the slide of the pistol, shown with the bushing/compensator installed on a slide of the gun in a locked position.
Figure 10A:
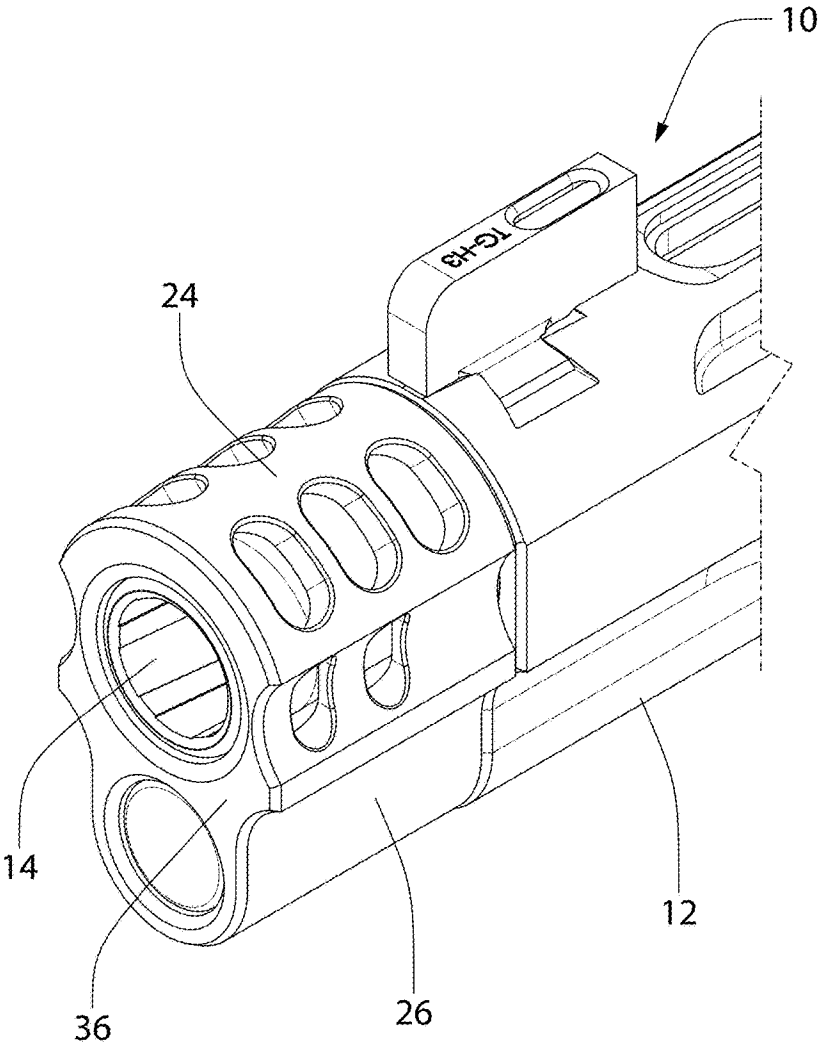
FIG. 10A is an isometric view of the bushing/compensator device as attached to a pistol of FIG. 1, shown with the bushing/compensator installed on a slide of the gun in a locked position.
Figure 11A:
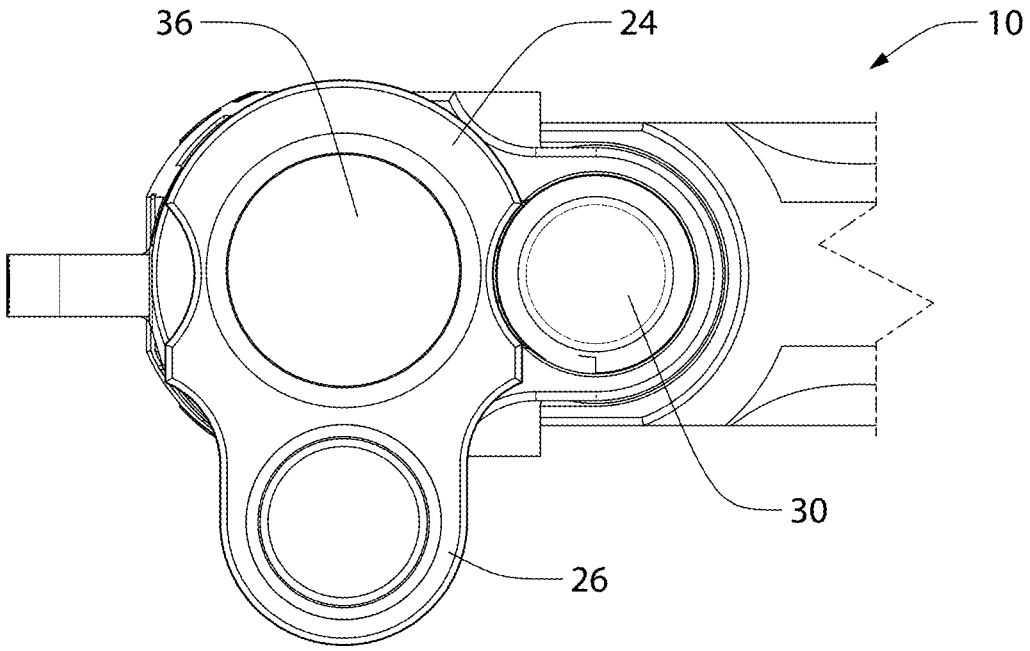
FIG. 11A is a front view of the bushing/compensator device as attached to a pistol of FIG. 10, shown with the bushing/compensator installed on a slide of the gun in a locked position.
Figure 11B:
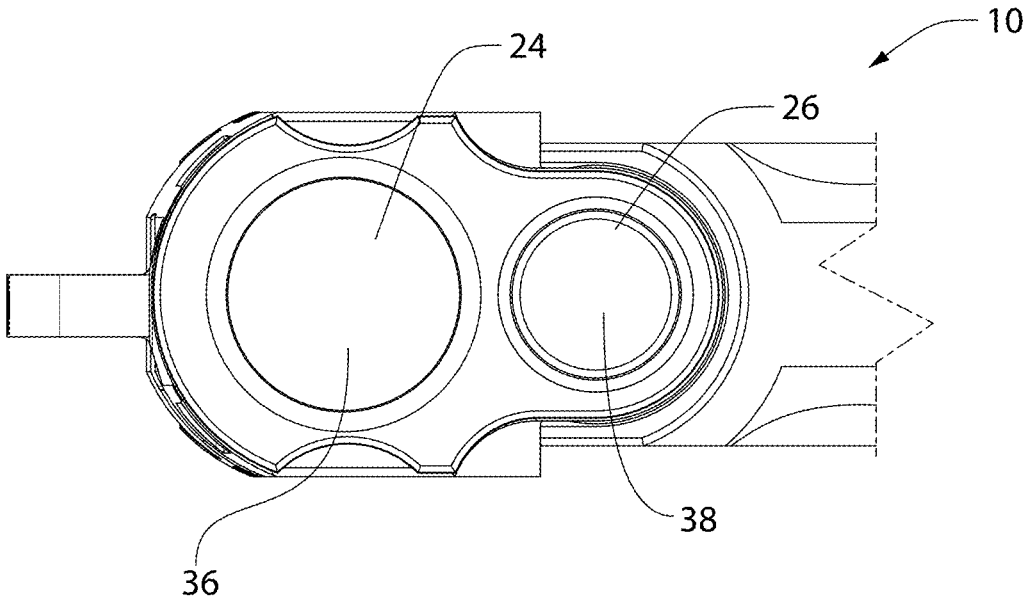
FIG. 11B is an isometric view of the bushing/compensator device as attached to a pistol of FIG. 1, shown with the bushing/compensator installed on a slide of the pistol in an unlocked position wherein disassembly of the pistol is possible by initially removing the bushing/compensator device from the slide of the pistol.
Figure 12:
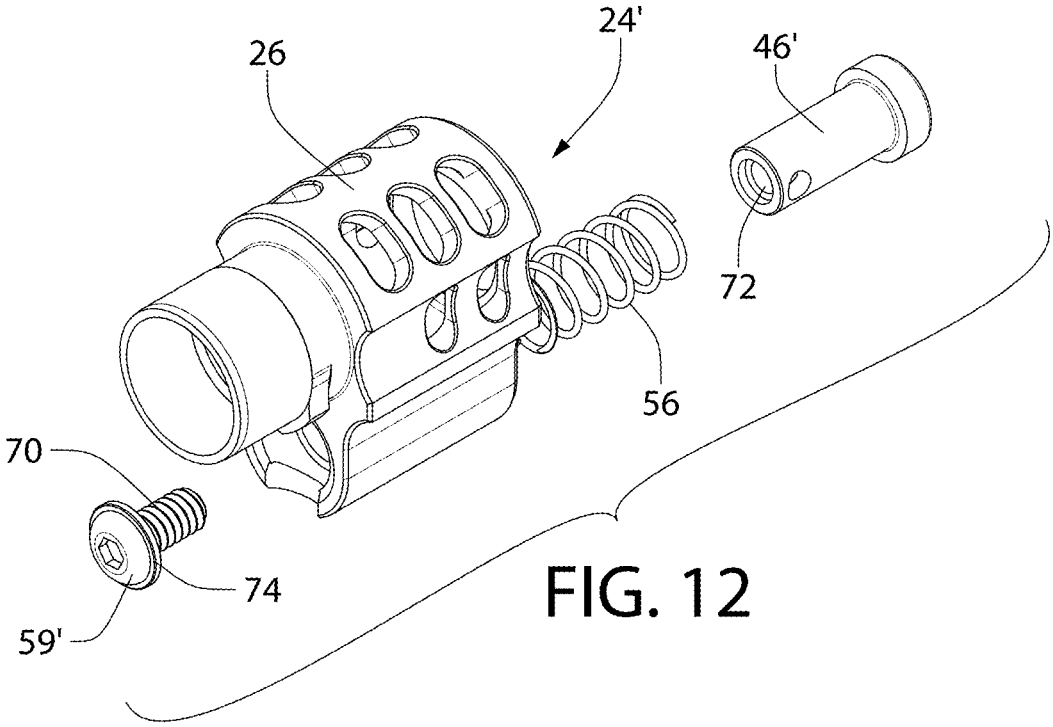
FIG. 12 is a top, front, exploded isometric view of an alternate embodiment of a bushing/compensator device.
Figure 13:
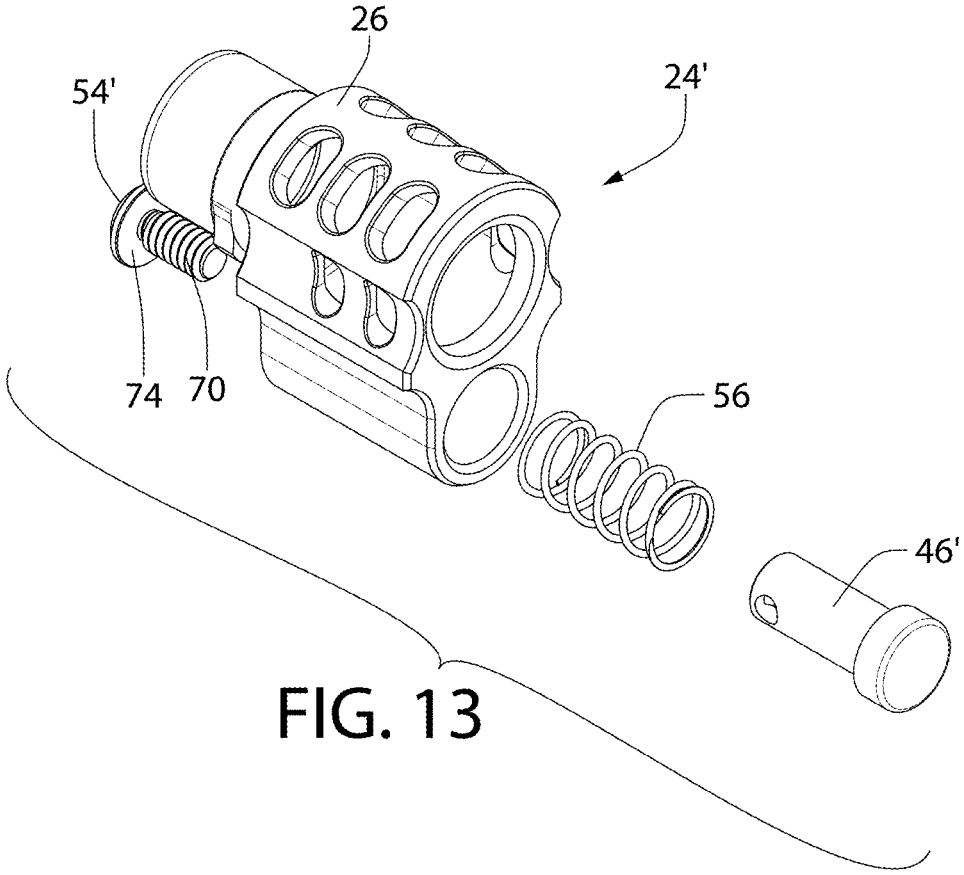
FIG. 13 is a rear, front, exploded isometric view of the alternate embodiment of a bushing/compensator device of FIG. 12.
Figure 14:
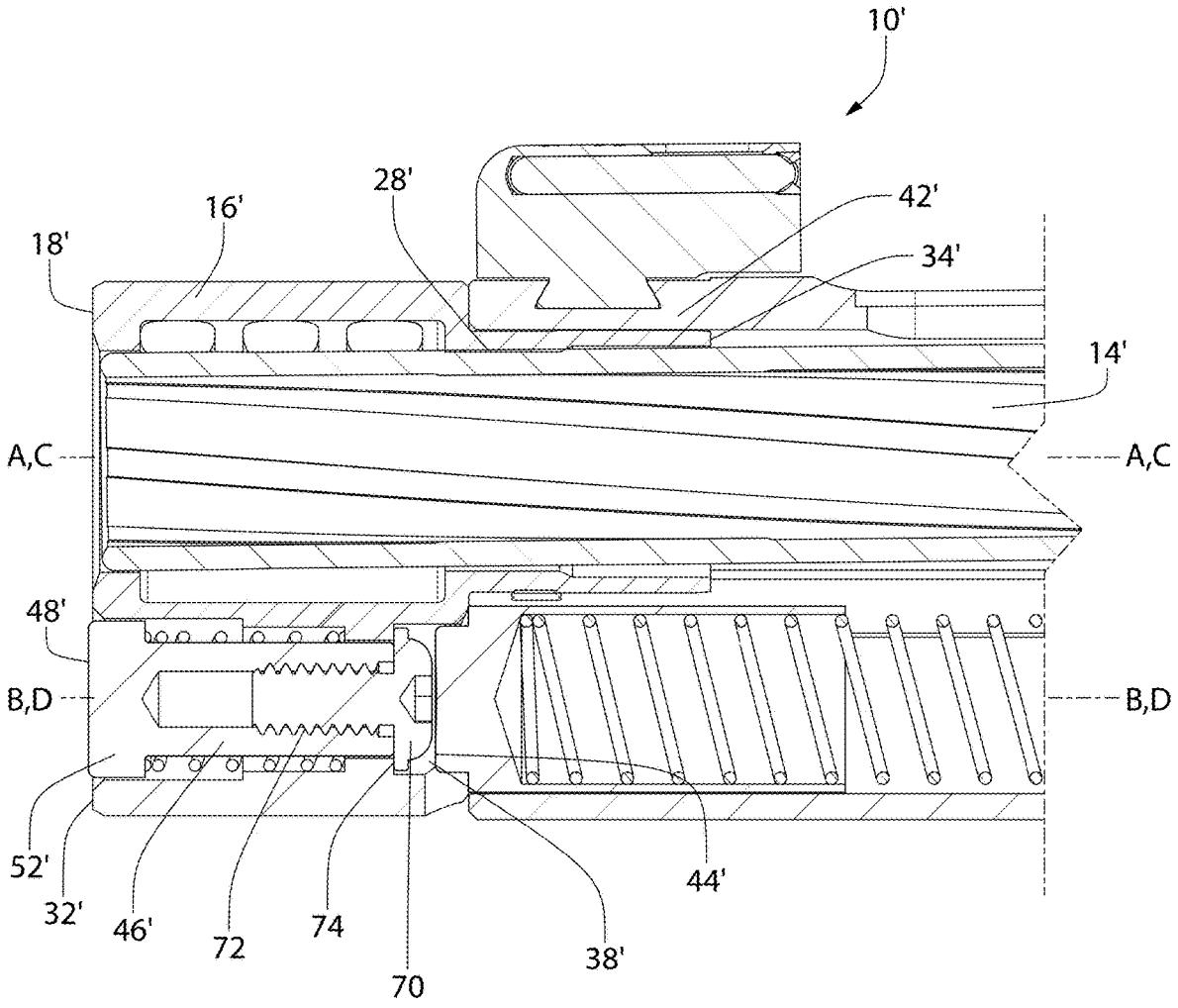
FIG. 14 is a cross-sectional view of the alternate embodiment of the bushing/compensator device as attached to a pistol of FIG. 12, shown with its rod in an undepressed condition.
Figure 15:
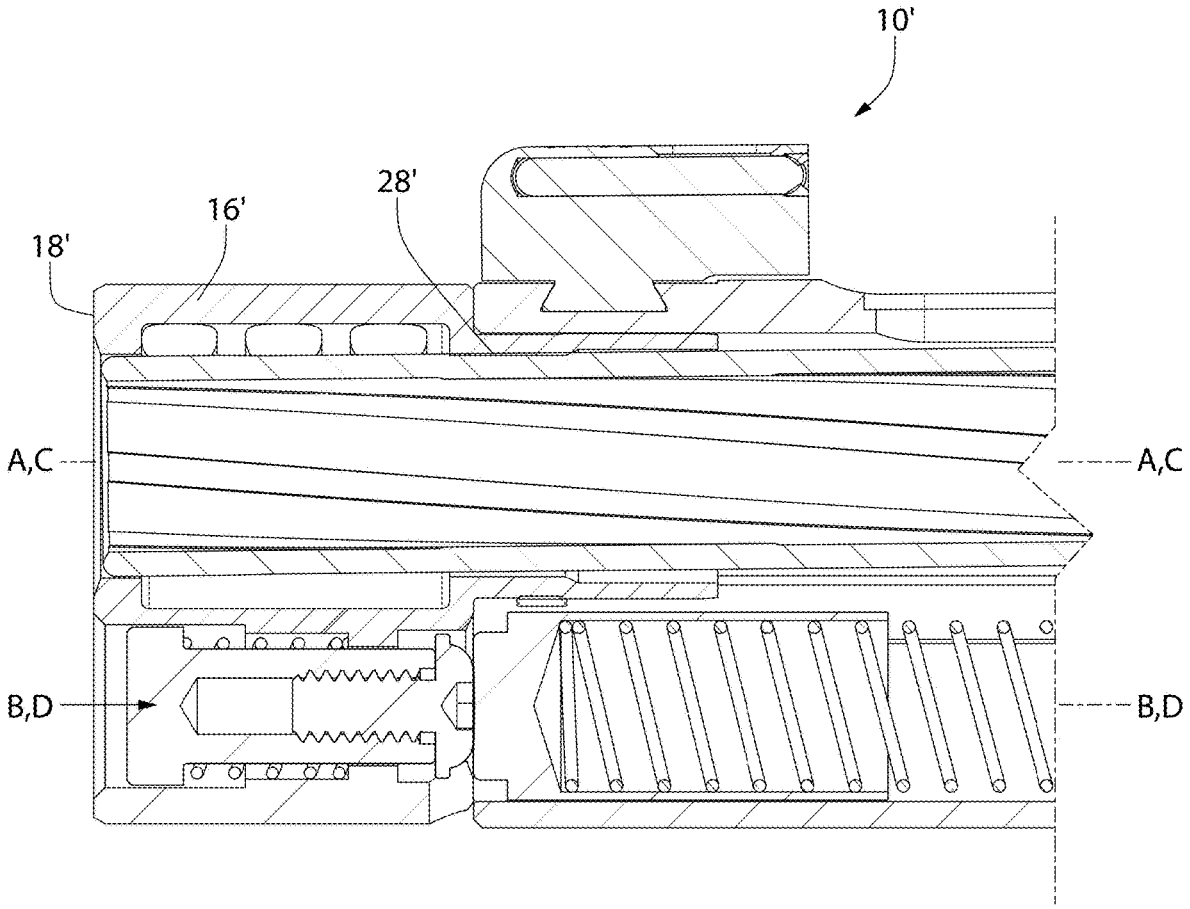
FIG. 15 is a cross-sectional view of the alternate embodiment of the bushing/compensator device of FIG. 12 as attached to a pistol, shown with its rod in a depressed condition.

The bushing/compensator device 24 includes a compensator member 26 (see also FIGS. 4-7) having a quarter turn bayonet mount 28 and a button assembly 30 (as described below). The compensator member 26 has a front end 32 and a rear end 34, and further includes a first aperture 36 extending between the front end 32 and the rear end 34. The first aperture 36 has a front end 36*a*, a rear end 38*a*, and a longitudinal axis C (see FIGS. 6 and 7) that is coaxial with the longitudinal axis A of the barrel 14 when the bushing/compensator device 24 is mounted on the slide 16. See FIG. 8. The compensator member 26 has a second aperture 38 extending between the front end 32 and the rear end 34. (see FIGS. 6 and 7). The second aperture 38 has a front end 38*a*, a rear end 38*b*, and a longitudinal axis D that is coaxial with the longitudinal axis B of the guide rod 23 of the pistol 10 when the bushing/compensator device 24 is mounted on the slide 16. The quarter turn bayonet mount 28 is disposed at the rear end 36*b* of the first aperture 36 and mates with a bayonet mount aperture 42 in the front end 18 of the slide 16. See FIGS. 1, 3, 8 and 9. When the bayonet mount 28 is in a locked position (see FIGS. 2, 8, 10A and 11B), the longitudinal axis D of the second aperture 38 is aligned with the longitudinal axis B of the guide rod 23 of the pistol 10, and when the bayonet mount 28 is rotated about coaxial longitudinal axes A (of the barrel) and C (of the first aperture 36) to of an unlocked position (see FIGS. 10B and 11A), the bushing/compensator device 24 is removable from the slide 16 when the button assembly 30 in a depressed condition as described below.

The button assembly 30 includes a rod, 46, a fastener 54 and a spring 56 and is slidingly retained in the second aperture 38. The rod 46 has a first end 48 and a second end 50. The first end 48 has a head 52 and the second end 50 is for receipt of a fastener 54. The rod 46 is slidable from a first longitudinal position (see FIG. 8) wherein the head 52 is adjacent to the front end 38*a* of the second aperture 38, to a second longitudinal position (see FIG. 9) wherein the second end 50 of the rod 46 depresses the tip 44 of the recoil spring plug 22. A user presses the head 52 (in the direction of the arrow in FIG. 9) to move the rod from the first position to the second position. The spring 56 (for example, a coil spring) biases the rod 46 to the first longitudinal position (see FIG. 8) (in a direction opposite direction of the arrow shown in FIG. 9).

Figure 7:
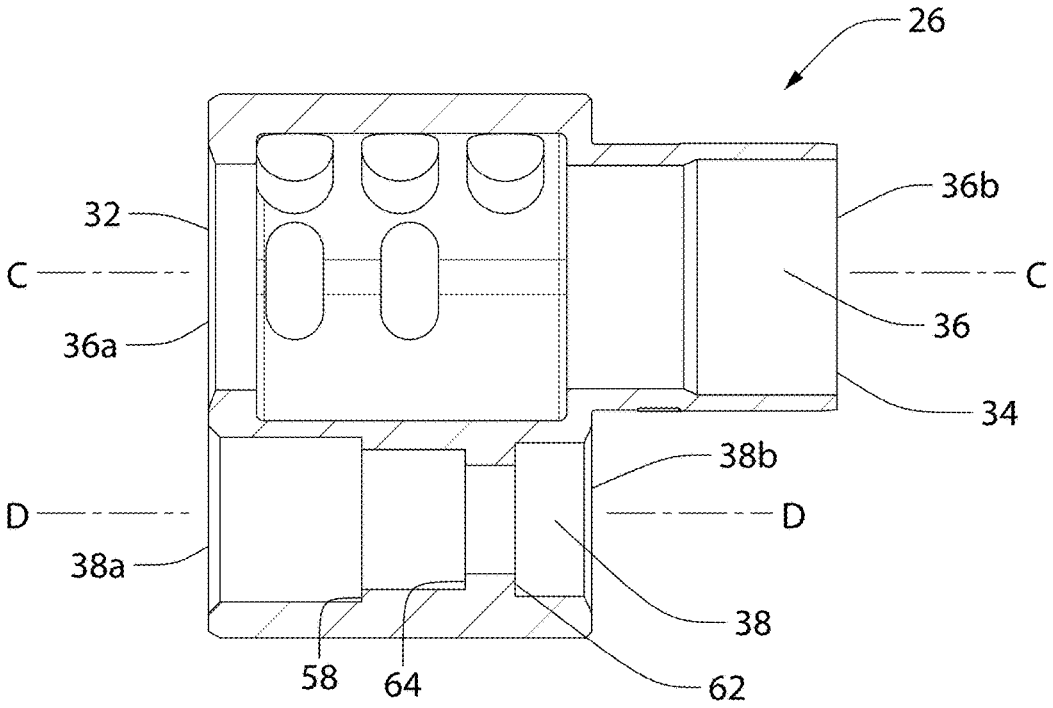
FIG. 7 is a cross-sectional view of the compensator member of FIG. 4, taken along lines A-A of FIG. 4.
Figure 8:
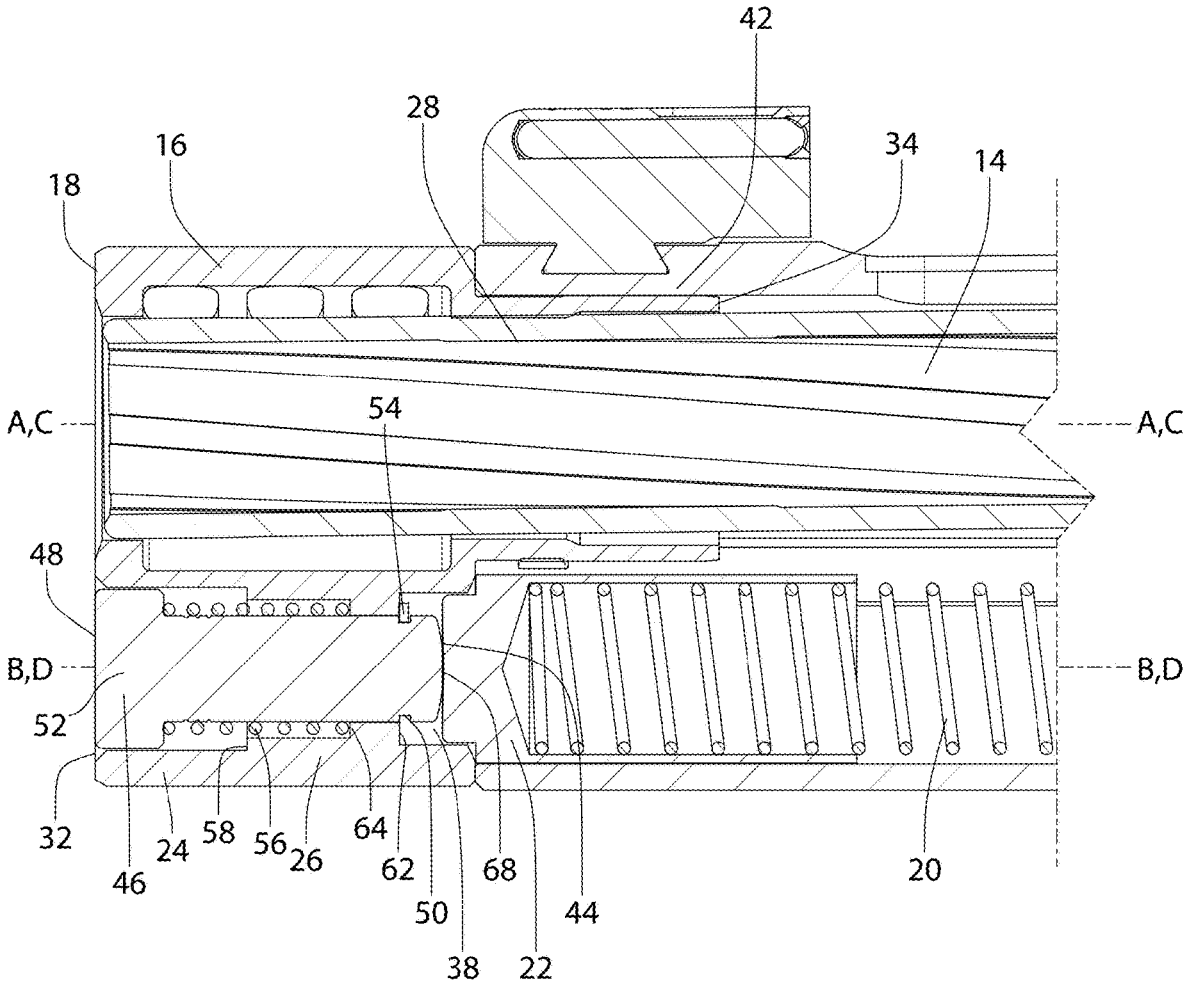
FIG. 8 is a cross-sectional view of the bushing/compensator device of FIG. 1 as attached to a pistol, taken along lines B-B of FIG. 2, shown with its rod in an undepressed condition.
Figure 9:
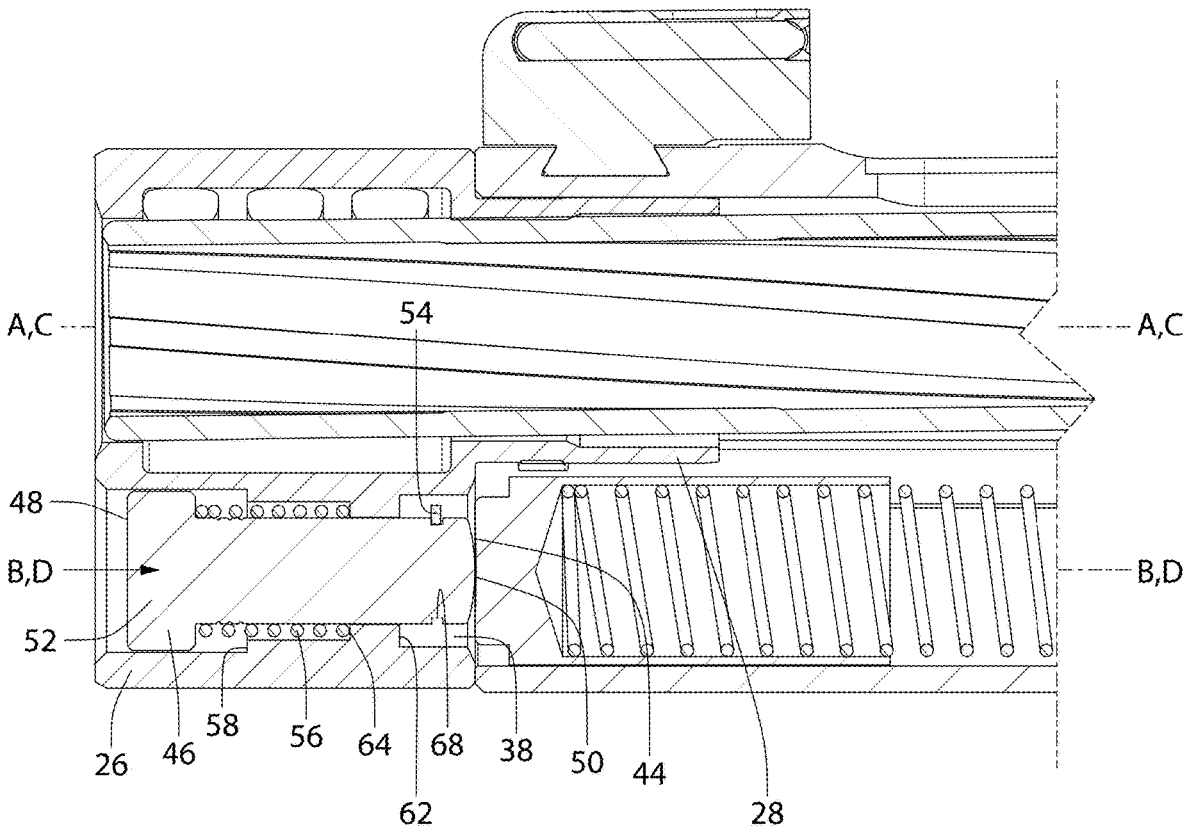
FIG. 9 is a cross-sectional view of the bushing/compensator device of FIG. 1, as attached to a pistol, taken along lines C-C of FIG. 2, shown with its rod in a depressed condition.

The second aperture 38 may further include first, second and third annular ledges, as described below. As shown in FIGS. 7, 8 and 9, the first annular ledge 58 engages the underside 60 of the head 52 of the rod 46 to provide for a stop when the rod 46 reaches the second position (see FIG. 9). It is noted that the stop need not be fully engaged as shown in FIG. 9. The second annular ledge 62 engages the fastener 54 to capture the rod 46 and provide for a stop when the rod 46 reaches the first longitudinal position (see FIG. 8). The third annular ledge 64 provides for the spring 56 to be captured between the third annular ledge 64 and the head 52 of the rod 46. See FIGS. 8 and 9. In the embodiment of FIGS. 1, 3, 8 and 9, the fastener 54 is shown as C-ring 66 disposed in an annular groove 68 in the rod 46. Alternatively, as shown in the alternate pistol 10' and bushing/compensator device 24' of FIGS. 12-15, the fastener 54' may be a screw 70 and threaded hole 72 in rod 46'. The underside of head 74 of the screw 70 acts in a substantially similar manner as the C-ring 66 mating with second annular ledge 62 to capture the rod 46 and provide a stop when the rod 46 reaches the first longitudinal position. Note that for ease of description, elements of the alternate pistol 10' that are substantially similar to that of pistol 10 of the initial exemplary embodiment have a prime symbol next to the related reference number. For example, bushing/compensator 24 is substantially similar to that of bushing/compensator device 24' of the second embodiment, and, therefore, all elements are not described in detail.

When a user depresses the first end 48 of the rod 46 (i.e., at the head 52), the second end 50 of the rod 46 depresses the recoil spring plug 22 providing clearance for the bushing/compensator device 24 to be rotatable from the locked position to the unlocked position.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. For a semiautomatic pistol having a frame, a barrel having a longitudinal axis, a slide having a front end surrounding the barrel, a recoil spring disposed in the slide, a recoil spring plug and a guide rod having a longitudinal axis, a bushing/compensator device for the semiautomatic pistol that provides for tool-less disassembly of the slide from the frame of the pistol, the bushing/compensator device comprising:

(a) a compensator member having a front end and a rear end, comprising:

(i) a first aperture extending between the front end and the rear end of the compensator member, the first aperture having a front end, a rear end, and a longitudinal axis that is coaxial with the longitudinal axis of the barrel; and (ii) a second aperture extending between the front end and the rear end of the compensator member, the second aperture having front end, a rear end, and a longitudinal axis that is coaxial with the longitudinal axis of the guide rod of the pistol when the bushing/compensator device is mounted on the slide;

(b) a quarter turn bayonet mount at a rear end of the first aperture that mates with a bayonet mount aperture in the front end of the slide, wherein when the bayonet mount is in a locked position, the longitudinal axis of the second aperture is aligned with the longitudinal axis of the guide rod of the pistol, and when the bayonet mount is rotated to an unlocked position, the bushing/compensator device is removable from the slide; and (c) a button assembly slidingly retained in the second aperture, the button assembly comprising:

(i) a rod having a first end and a second end, the first end having a head, the second end for receipt of a fastener, the rod slidable from a first longitudinal position wherein the head is adjacent to the front end of the second aperture, to a second longitudinal position wherein the second end of the rod depresses the recoil spring plug; and (ii) a spring to bias the rod to the first longitudinal position;

whereby, when a user depresses the first end of the rod, the second end of the rod depresses the recoil spring plug providing clearance to provide for the bushing/compensator device to be rotated from the locked position to the unlocked position.

2. The bushing/compensator device of claim 1, wherein the second aperture includes a first annular ledge to engage the head of the rod to provide for a stop when the rod reaches the second position.

3. The bushing/compensator device of claim 2, wherein the second aperture includes a second annular ledge to engage the fastener to provide for a stop when the rod reaches the first position.

4. The bushing/compensator device of claim 1, wherein the second aperture includes a third annular ledge such that the spring is captured between the third annular ledge and the head of the rod.

5. For a semiautomatic pistol having a frame, a barrel having a longitudinal axis, a slide having a front end surrounding the barrel, a recoil spring disposed in the slide, a recoil spring plug and a guide rod having a longitudinal axis, a bushing/compensator device for the semiautomatic pistol that provides for tool-less disassembly of the slide from the frame of the pistol, the bushing/compensator device comprising:

(a) a compensator member having a front end and a rear end, comprising:

(i) a first aperture extending between the front end and the rear end of the compensator member, the first aperture having a longitudinal axis that is coaxial with the longitudinal axis of the barrel; and (ii) a second aperture extending between the front end and the rear end of the compensator member, the second aperture having a longitudinal axis that is coaxial with the longitudinal axis of the guide rod of the pistol when the compensator or mounted on the slide;

(b) a quarter turn bayonet mount at the rear end of the first aperture that mates with a bayonet mount aperture in the front end of the slide, wherein when the bayonet mount is in a locked position, the longitudinal axis of the second aperture is aligned with the longitudinal axis of the guide rod of the pistol, and when the bayonet mount is rotated to an unlocked position, the bushing/compensator device is removable from the slide; and (c) a button assembly slidingly retained in the second aperture, the button assembly comprising:

(i) a rod having a first end and a second end, the first end having a head, the second end for receipt of a fastener, the rod slidable from a first longitudinal position wherein the head is adjacent to the front end of the second aperture, to a second longitudinal position wherein the second end of the rod depresses the recoil spring plug; and (ii) a spring to bias the rod to the first longitudinal position; and (d) wherein the second aperture further comprises:

(i) a first annular ledge to engage the head of the rod to provide for a stop when the rod reaches the second position;

(ii) a second annular ledge to engage the fastener to provide for a stop when the rod reaches the first position; and (iii) a third annular ledge such that the spring is captured between the third annular ledge and the head of the rod;

whereby, when a user depresses the first end of the rod, the second end of the rod depresses the recoil spring plug providing clearance to provide for the bushing/compensator device to be rotated from the locked position to the unlocked position.

* * * * *